US007597605B2

(12) United States Patent
Yang

(10) Patent No.: US 7,597,605 B2
(45) Date of Patent: Oct. 6, 2009

(54) DECORATIVE DEVICE ENABLING ORNAMENTS TO ROTATE AND MOVE UP AND DOWN INSIDE A CRYSTAL BALL AMIDST FLUTTERING, SHINY DISC SNOWFLAKES

(75) Inventor: Shin-Ya Yang, Hsin Tien (TW)

(73) Assignee: Ya Yung Enterprise Co., Ltd., Taipei Hsien (TW)

( * ) Notice: Subject to any disclaimer, the term of this patent is extended or adjusted under 35 U.S.C. 154(b) by 443 days.

(21) Appl. No.: 11/701,297

(22) Filed: Jan. 31, 2007

(65) Prior Publication Data

US 2008/0182481 A1 Jul. 31, 2008

(51) Int. Cl.
*A63H 3/52* (2006.01)

(52) U.S. Cl. ..... 446/267; 40/406; 40/410; 40/426

(58) Field of Classification Search ..... 446/153, 446/156, 236, 267; 40/406, 409, 410, 411, 40/426, 430; 74/412 R, 413
See application file for complete search history.

(56) References Cited

U.S. PATENT DOCUMENTS 5,203,743 A * 4/1993 Hou et al. ..... 472/7
5,286,535 A * 2/1994 Hou ..... 428/11
5,556,318 A * 9/1996 So ..... 446/236
5,617,658 A * 4/1997 Chen ..... 40/411
5,640,791 A * 6/1997 Fong ..... 40/414
5,666,750 A * 9/1997 Segan et al. ..... 40/410
5,706,596 A * 1/1998 How ..... 40/414
5,896,687 A * 4/1999 Lo ..... 40/411
6,030,273 A * 2/2000 Hsu ..... 446/267
6,052,930 A * 4/2000 Hermanson et al. ..... 40/410
6,132,284 A * 10/2000 Lin ..... 446/267
6,357,151 B1 * 3/2002 Yuen ..... 40/406
6,523,287 B1 * 2/2003 Lee ..... 40/410
6,582,273 B2 * 6/2003 Chen ..... 446/238
6,638,135 B2 * 10/2003 Fong ..... 446/242
6,651,364 B2 * 11/2003 Hermanson et al. ..... 40/409
6,663,461 B2 * 12/2003 Fong ..... 446/236
6,764,375 B1 * 7/2004 Hsu ..... 446/236
6,857,929 B2 * 2/2005 Liao et al. ..... 446/267
6,978,564 B2 * 12/2005 Hou ..... 40/406

* cited by examiner

*Primary Examiner*—Gene Kim
*Assistant Examiner*—Scott Young
(74) *Attorney, Agent, or Firm*—Pro-Techtor Int'l Services; Ralph Willgohs

(57) ABSTRACT

A decorative device enabling ornaments to rotate and move up and down inside a crystal ball amidst fluttering, shiny disc snowflakes, which uses a device structured from a motor mechanism, a gear mechanism, a rotary mechanism and a crystal ball so that when a motor drives and rotates transmission gears of the gear mechanism, apart from using mutually repelling of two double-sided magnets to drive and rotate a magnet impeller wheel, and thereby cause whirling of water and fluttering of shiny disc snowflakes within the crystal ball, moreover, rotating of a transmission shaft causes rotating of a rotary tray and toy figurines suspended from lower ends of ornament hanger rods. Furthermore, large and small umbrella-shaped gears drive and rotate eccentric wheels, thereby driving and causing up and down movements of the toy figurines.

3 Claims, 5 Drawing Sheets

DECORATIVE DEVICE ENABLING ORNAMENTS TO ROTATE AND MOVE UP AND DOWN INSIDE A CRYSTAL BALL AMIDST FLUTTERING, SHINY DISC SNOWFLAKES

BACKGROUND OF THE INVENTION (a) Field of the Invention

The present invention relates to a design of a snowflakes crystal ball, and more particularly to a multifunctional design of a snowflakes crystal ball enabling ornaments to rotate and move up and down inside a crystal ball amidst fluttering, striking shiny disc snowflakes.

(b) Description of the Prior Art

Liquid flowing inside a conventional snowflake crystal ball causes the fluttering of shiny discs, thereby forming the striking appearance of fluttering snowflakes. However, toy figurines or ornaments disposed interior of the crystal ball are not provided with functionality to move up and down or sway from side to side, and thus the crystal ball is merely provided with the function to produce the impression of striking snowflakes. Hence, there is a need for improvement on prior art.

SUMMARY OF THE INVENTION

A primary object of the present invention is to provide a striking snowflakes crystal ball of prior art with distinctive toy figurines or ornaments disposed interior thereof, in addition, apart from using a rotary tray to enable rotating the toy figurines or ornaments, moreover, relatively large and small umbrella-shaped gears are used to drive and rotate eccentric wheels to cause up and down movements of the toy figurines or ornaments respectively suspending from lower ends of ornament hanger rods.

To enable a further understanding of said objectives and the technological methods of the invention herein, brief description of the drawings is provided below followed by detailed description of the preferred embodiments.

DETAILED DESCRIPTION OF THE PREFERRED EMBODIMENTS

Figure 1:
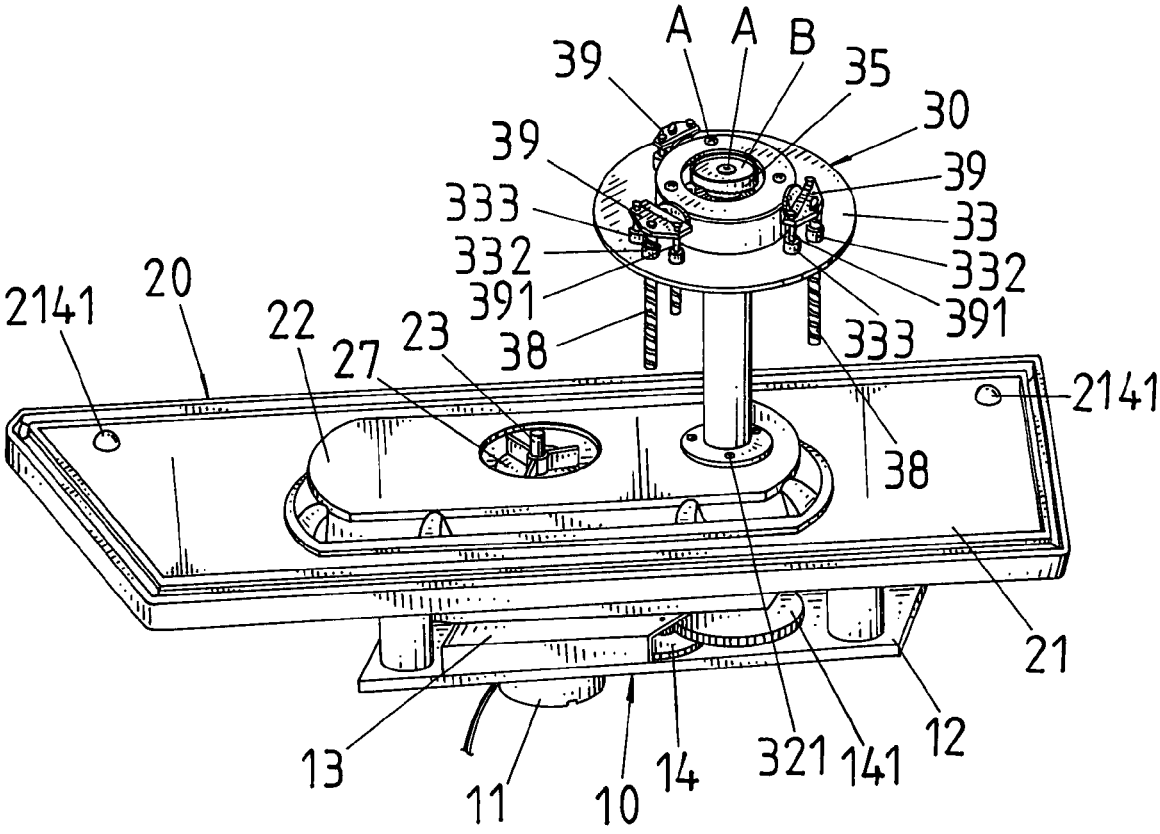
FIG. 1 shows an elevational view depicting assembly of a motor mechanism, gear mechanism and rotary mechanism according to the present invention.
Figure 2:
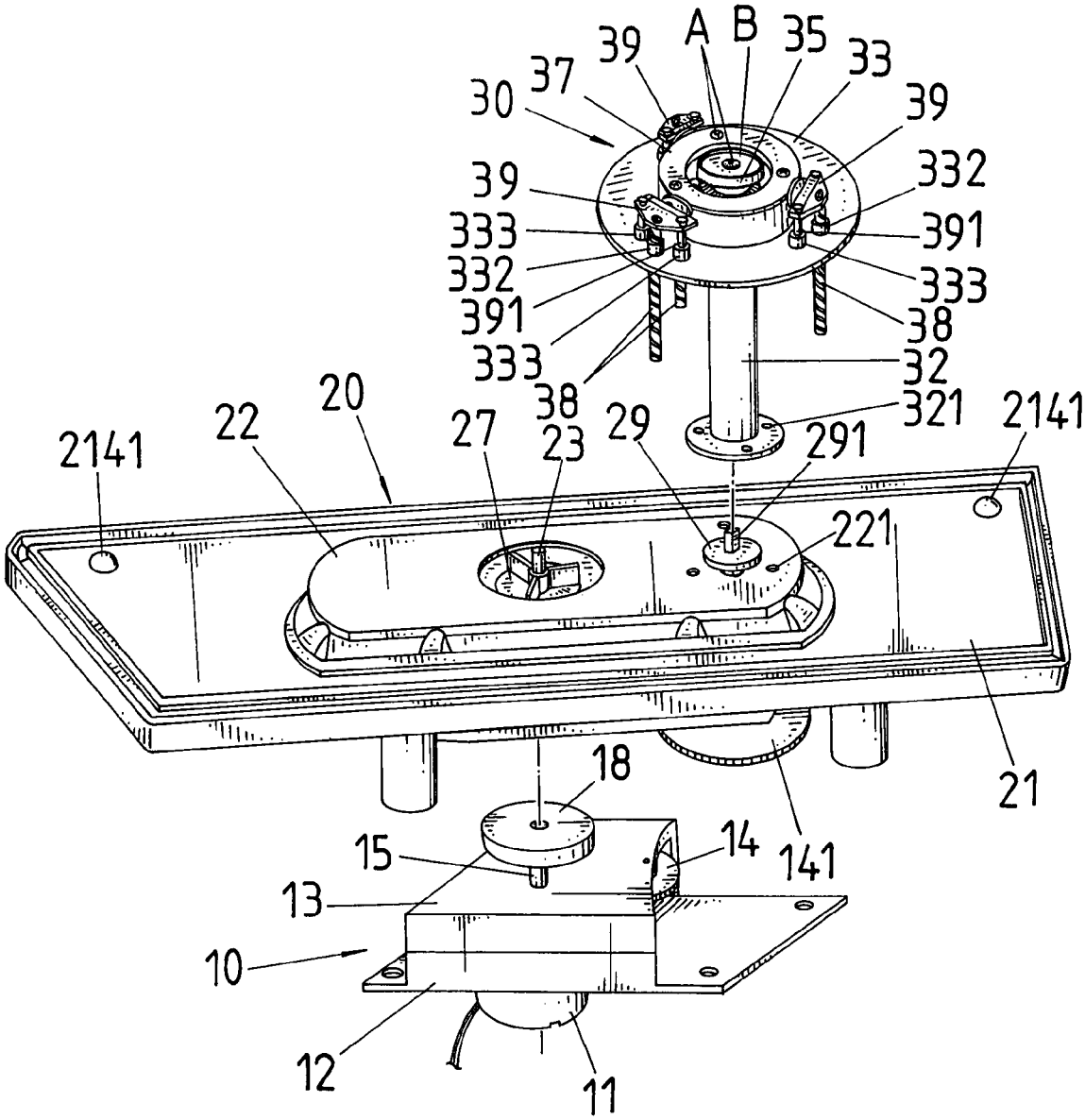
FIG. 2 shows an exploded elevational view of the motor mechanism, the gear mechanism and the rotary mechanism according to the present invention.

Referring to FIGS. 1 and 2, which show the present invention primarily structured to comprise a motor mechanism 10, a gear mechanism 20, a rotary mechanism 30 and a crystal ball 40

Figure 5:
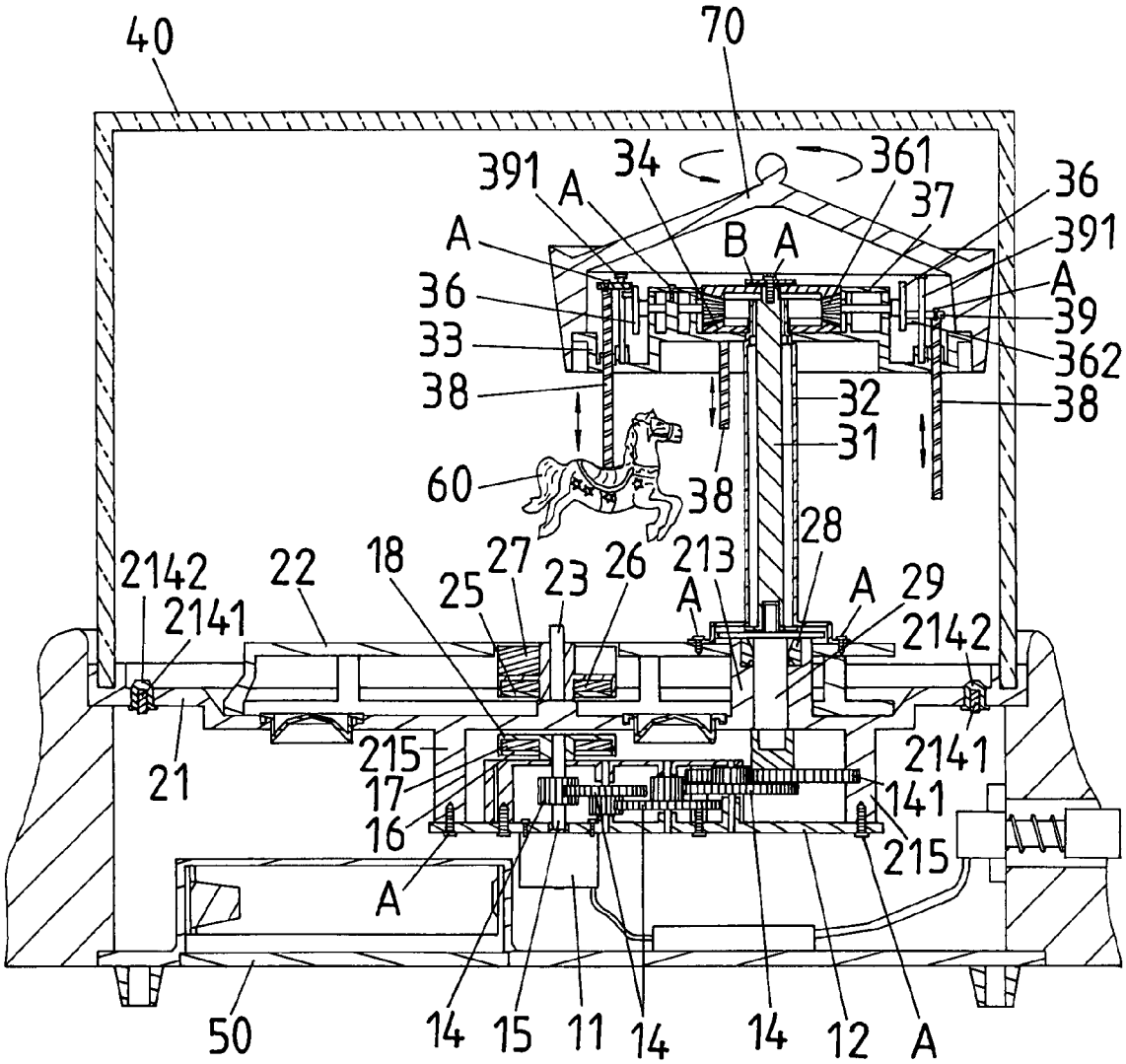
FIG. 5 shows a cross-sectional view of the present invention.

Referring to FIG. 5, which shows a base 50 disposed beneath the crystal ball 40 used to retain the aforementioned mechanisms, and wherein the crystal ball 40 is filled with water and shiny disc snowflakes (not shown in the drawings).

The motor mechanism 10 is installed beneath the gear mechanism 20, and the rotary mechanism 30 is installed above the gear mechanism 20.

Figure 3:
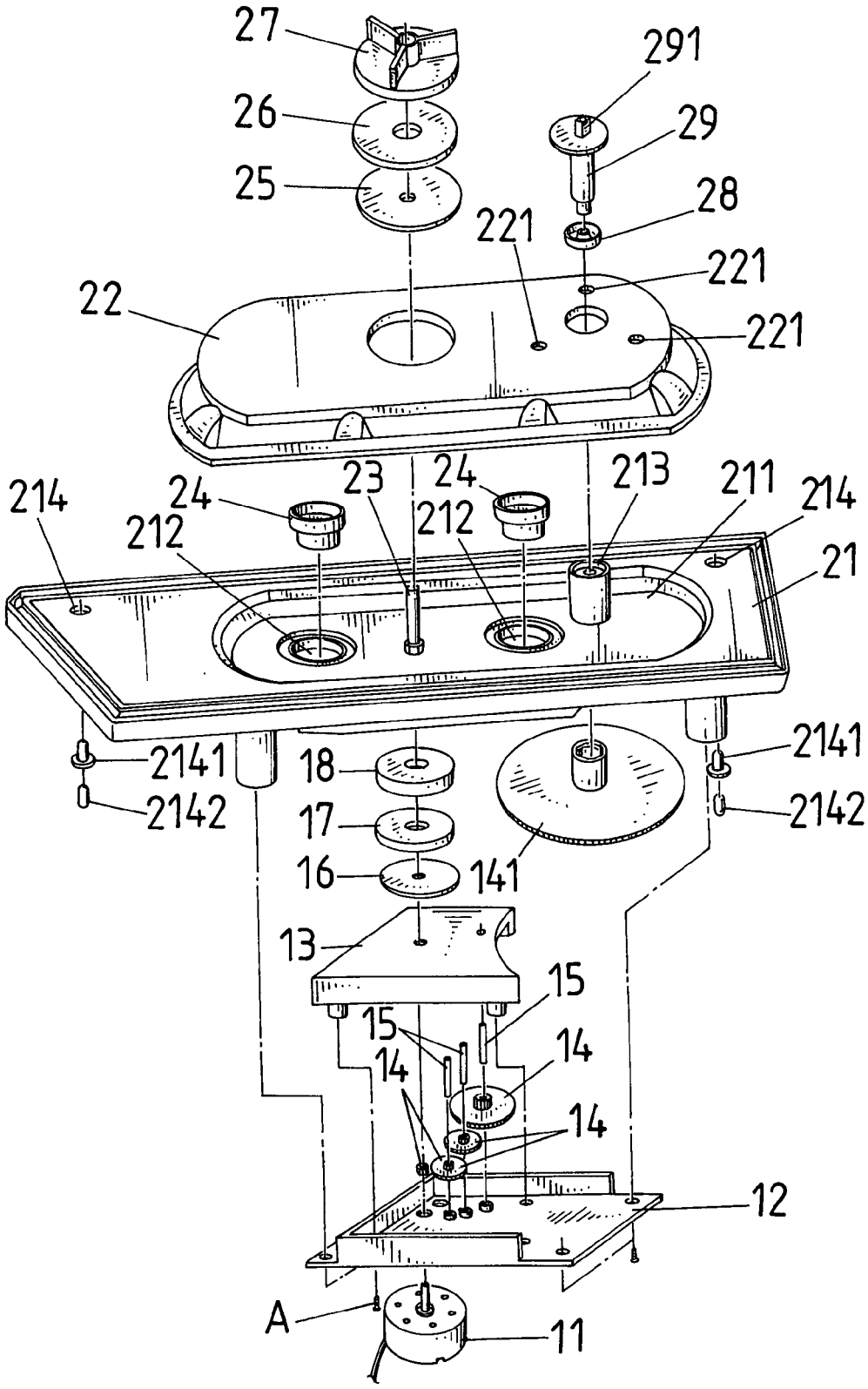
FIG. 3 shows an exploded elevational view of the motor mechanism and the gear mechanism according to the present invention.

Referring to FIG. 3, wherein the motor mechanism 10 is structured to comprise a motor 11, a gear set supporting frame 12, a gear set gland 13, four transmission gears 14, gear shafts 15, a magnet gland 16, a double-sided magnet 17 and a transmission magnet gland 18. The four transmission gears 14 and a transmission gear 141 are installed between the gear set supporting frame 12 and the gear set gland 13 (see FIG. 5), and the motor 11 is installed beneath the gear set supporting frame 12. The gear shafts 15 are linked to the transmission gears 14, and, after penetrating the gear set gland 13, respectively penetrate the magnet gland 16, the double-sided magnet 17 and the transmission magnet gland 18. The gear mechanism 20 is structured to comprise a carrier frame 21, a gland 22, a magnet impeller shaft 23, two air rubber plugs 24, a magnet gland 25, a double-sided magnet 26, a magnet impeller 27, a watertight gasket 28 and a main transmission shaft 29. The gland 22 is disposed on and covers a recess 211 of the carrier frame 21, and two air rubber plug holes 212 defined in the recess 211 enable the two air rubber plugs 24 to be respectively embedded therein. The magnet impeller shaft 23 center of the recess 211 respectively penetrates the magnet gland 25, the double-sided magnet 26 and the magnet impeller 27. A watertight ring support 213 at one end of the recess 211 enables the watertight gasket 28 and the main transmission shaft 29 to be disposed interior thereof, and watertight plastic plug holes 214 each having a watertight plug 2141 and an expanding bolt 2142 fixedly bolted therein are respectively defined lateral to the recess 211. A lower portion of the carrier frame 21 is provided with fixing posts 215, and screws A penetrate the gear set supporting frame 12 and are fixedly bolted within post holes of the fixing posts 215.

Figure 4:
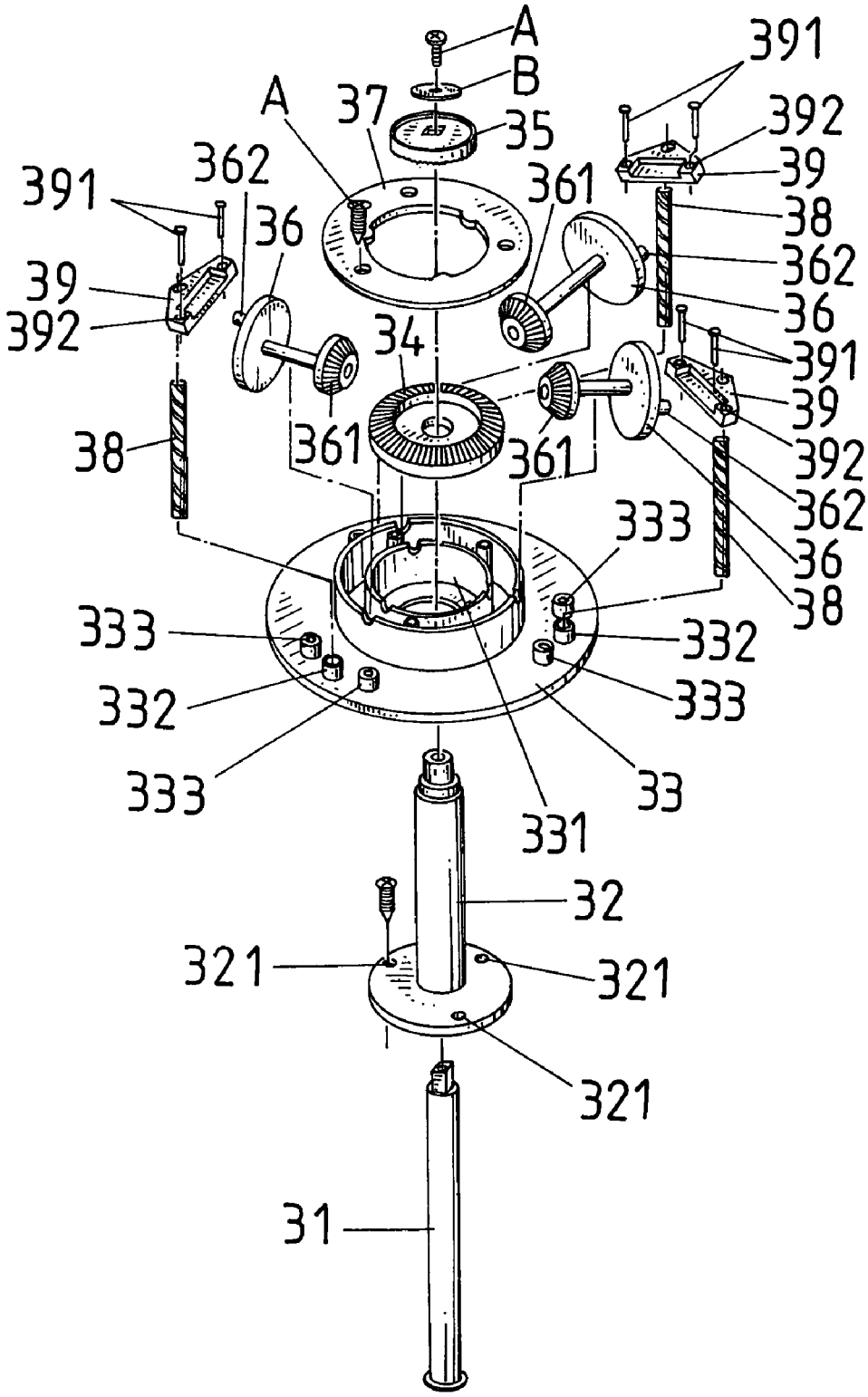
FIG. 4 shows an exploded elevational view of the rotary mechanism according to the present invention.

Referring to FIG. 4, which shows the rotary mechanism 30 structured to comprise a transmission shaft 31, a fixing post sleeve 32, a rotary tray 33, two large umbrella-shaped gears 34, 35, three eccentric wheels 36, a gear gland 37, three ornament hanger rods 38, sliding pieces 39 and sliding piece shafts 391, wherein a bottom portion of the transmission shaft 31 enables an embedding piece 291 of the main transmission shaft 29 to fixedly embed therein, thereby fixing position (see FIG. 5). The transmission shaft 31 upwardly penetrates the fixing post sleeve 32, the rotary tray 33, the two large umbrella-shaped gears 34, 35, the gear gland 37 and a filling piece B. A screw A fixedly bolts into a top end of the transmission shaft 31, and three screws A respectively penetrate through holes 321 of a bottom disk of the fixing post sleeve 32 and are fixedly bolted into bolt holes 221 of the gland 22. A circular recess 331 of the rotary tray 33 enables the large umbrella-shaped gear 34 to be disposed therein, and small umbrella-shaped gears 361 respectively located at ends of the three eccentric wheels 36 extend into the circular recess 331 and mesh with the large umbrella-shaped gear 34, the gear gland 37 is then used as a cover and is fixedly bolted with the screw A onto the rotary tray 33. A protruding pin 362 is located on an outer side of each of the eccentric wheels 36, and each of the protruding pins 362 abuts against a lower portion of each of the sliding pieces 39. The three ornament hanger rods 38 respectively penetrate post holes 332 of the rotary tray 33 and are fixedly bolted using bolts. The two sliding piece shafts 391 respectively penetrate shaft holes 392 of the sliding pieces 39 and fixedly embed into cylindrical posts 333 of the rotary tray 33.

Referring to FIG. 5, which shows the ornament hanger rods 38 installed on the carrier frame 21 and disposed interior of the crystal ball 40, wherein toy figurines 60 or horse ornaments are respectively suspended from lower ends of the ornament hanger rods 38, and the rotary tray 33 is covered with a roof 70. When the motor 11 drives and rotates the transmission gears 14, 141, apart from mutual repelling of the upper and lower double-sided magnets 26, 17 driving and rotating the magnet impeller wheel 27, and thereby causing the whirling of water and fluttering of shiny disc snowflakes, moreover, the transmission shaft 31 is caused to rotate, thereby rotating the rotary tray 33 and the toy figurines 60 installed thereto. Furthermore, the large and small umbrella-shaped gears 34, 35 and 361 drive and rotate the eccentric wheels 36, thereby driving and causing up and down movements of the toy figurines 60 suspended from the lower ends of the ornament hanger rods 38. The crystal ball 40 can be square shaped or designed with different shapes, including circular shaped, diamond shaped, and so on.

In conclusion, the crystal ball 40 of the present invention has functionality to give the impression of fluttering, striking shiny disc snowflakes of prior art, as well as providing functionality to enable rotating and up and down or swaying movements of the toy figurines 60. Furthermore, the crystal ball 40 of the present invention further enables configuration with a music bell.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A decorative device enabling ornaments to rotate and move up and down inside a crystal ball amidst fluttering, shiny disc snowflakes, comprising:

a motor mechanism, comprising: a motor; a gear set supporting frame positioned above the motor; a gear set gland that covers the gear set supporting frame; a plurality of transmission gears positioned between the gear set supporting frame and the gear set gland; and which mutually mesh; a plurality of gear shafts respectively extending into centers of the transmission gears; a lower magnet gland positioned above the gear set gland that enables the gear shafts to penetrate therethrough; a lower double-sided magnet positioned above the lower magnet gland that enables the gear shafts to penetrate therethrough; a transmission magnet gland positioned above the lower double-sided magnet that enables the gear shafts to penetrate therethrough;

a gear mechanism, comprising: a carrier frame, an upper surface of which is provided with a recess, two air rubber plug holes and a watertight ring support; a carrier frame gland that covers the recess of the carrier frame, a plurality of bolt holes are defined in the carrier frame gland; a magnet impeller shaft positioned center of the recess of the carrier frame; two air rubber plugs that are respectively fixedly plugged into the air rubber plug holes; an upper magnet gland positioned in the carrier frame gland that enables the magnet impeller shaft to penetrate therethrough; an upper double-sided magnet positioned above the upper magnet gland that enables the magnet impeller shaft to penetrate therethrough; a magnet impeller positioned above the upper double-sided magnet that enables the magnet impeller shaft to penetrate therethrough; a watertight gasket positioned within the watertight ring support of the carrier frame; a main transmission shaft that penetrates the watertight gasket and extends into the watertight ring support of the carrier frame, an upper portion of the main transmission shaft is provided with an embedding piece;

a rotary mechanism, comprising: a transmission shaft, a bottom end of which enables the embedding piece of the main transmission shaft to fixedly embed therein; a fixing post sleeve fixedly disposed on the transmission shaft, screws penetrate through holes of a bottom disk of the fixing post sleeve to enable fixedly bolting into the bolt holes of the carrier frame gland; a rotary tray, center of which is provided with a circular recess, and a plurality of post holes are defined lateral to the circular recess; two large umbrella-shaped gears that are respectively disposed within the circular recess of the rotary tray; a plurality of eccentric wheels, an outer side of each of which is provided with a protruding pin, small umbrella-shaped gears respectively located at ends of the eccentric wheels extend into the circular recess of the rotary tray and respectively mesh with the large umbrella-shaped gears; a gear gland that covers the circular recess of the rotary tray and is fixedly bolted using a screw; a screw that penetrates a filling piece and is fixedly bolted into a top end of the transmission shaft; a plurality of ornament hanger rods that respectively penetrate the post holes of the rotary tray and are fixedly bolted with screws, a toy figurine or ornament suspends from a lower end of each of the ornament hanger rods; a plurality of sliding pieces that enable the protruding pins of the eccentric wheels to abut against the sliding pieces, sliding piece shafts respectively penetrate shaft holes defined in the sliding pieces and fixedly embed into cylindrical posts of the rotary tray;

a crystal ball that is disposed on and seals the carrier frame, the crystal ball is filled with water and shiny disc snowflakes, and when the motor drives and rotates the transmission gears, then mutually repelling of the upper and lower double-sided magnets drive and rotate the magnet impeller wheel, thereby causing whirling of the water and fluttering of the shiny disc snowflakes, moreover, the transmission shaft is caused to rotate, thereby rotating the rotary tray and the toy figurines or ornaments installed thereto, and the large and small umbrella-shaped gears drive and rotate the eccentric wheels, thereby driving and causing up and down movements of the toy figurines or ornaments suspended from the lower ends of the ornament hanger rods.

2. The decorative device enabling ornaments to rotate and move up and down inside a crystal ball amidst fluttering, shiny disc snowflakes in accordance with claim 1, wherein outer sides of the carrier frame of the rotary mechanism are provided with watertight plastic plug holes, each of which enables a watertight plug and an expanding bolt to be fixedly bolted therein.

3. The decorative device enabling ornaments to rotate and move up and down inside a crystal ball amidst fluttering, shiny disc snowflakes in accordance with claim 1, wherein the crystal ball is circular shaped, diamond shaped or square shaped.

* * * * *